United States Patent [19]

Psenka

[11] 3,942,795

[45] Mar. 9, 1976

[54] TABLE TENNIS GAME

[76] Inventor: Joseph A. Psenka, 4797 Stoneleigh, Bloomfield Hills, Mich. 48013

[22] Filed: Aug. 23, 1974

[21] Appl. No.: 500,153

Related U.S. Application Data

[63] Continuation-in-part of Ser. No. 187,000, Oct. 6, 1971, abandoned, which is a continuation-in-part of Ser. No. 27,125, April 9, 1970, Pat. No. 3,659,850, which is a continuation of Ser. No. 615,816, Feb. 13, 1967, abandoned.

[52] U.S. Cl...... 273/30; 273/102 S; 273/102.1 B; 273/103

[51] Int. Cl.[2]..... A63B 39/00

[58] Field of Search..... 273/102.2 R, 102 S, 105 R, 273/127 C, 103, 30, 179 C, 179 R, 182 R, 182 A, 95 R, 105 R, 105 A, 1 R, 181 R, 181 A, 181 F, 181 J, 176 FB, 176 E, 102 R, 102.1 B

[56] References Cited

UNITED STATES PATENTS

| | | | |
|---|---|---|---|
| 724,920 | 4/1903 | McKelvey | 273/102.1 B |
| 768,397 | 8/1904 | Norton et al. | 273/103 |
| 1,558,767 | 10/1925 | Smith | 273/179 R |
| 1,629,907 | 5/1927 | Dwyer | 273/182 A |
| 1,948,995 | 2/1934 | Regenold | 273/103 |
| 2,145,840 | 1/1939 | Thompson et al. | 273/105 A X |
| 3,589,724 | 6/1971 | Barlow | 273/1 R |

FOREIGN PATENTS OR APPLICATIONS

| | | | |
|---|---|---|---|
| 473,665 | 10/1937 | United Kingdom | 273/30 |
| 289,535 | 4/1928 | United Kingdom | 273/176 FB |
| 311,017 | 5/1929 | United Kingdom | 273/179 C |

*Primary Examiner*—Anton O. Oechsle
*Assistant Examiner*—T. Brown
*Attorney, Agent, or Firm*—Whittemore, Hulbert & Belknap

[57] ABSTRACT

A game board in combination with a table tennis table, the board being movable on the table to selected positions and angularly adjustable both as to angle of inclination from the horizontal and angle of inclination with respect to the longitudinal axis of the table.

The board is provided with a first opening near its upper edge and a second opening adjacent the lower edge of the board. The first opening is provided with an insert ring having a through opening smaller than the first opening and dimensioned to fit therein, the insert having a radial flange shaped to fit within recess surround the first opening such that the insert will be coplanar with the front surface of the board. A guide chute is attached to the rear of the board such that a ball entering the first opening will gravitate through the chute to the second opening to be expelled forwardly therefrom to roll along the table to return to a player. The chute is provided with inwardly extending projections for engagement with a ball passing through the chute to produce an audible sound. A net is supported substantially around the entire peripheral edge of board by support posts which are inserted in sockets in the board and are frictionally held therein.

Preferably, the combination includes the net ordinarily provided on the table tennis table and the board is provided with an opening through which a ball may pass, and a chute connected to the rear of the board to receive a ball passing through the opening and to lead it forwardly beneath the net to the player.

3 Claims, 15 Drawing Figures

FIG. 1
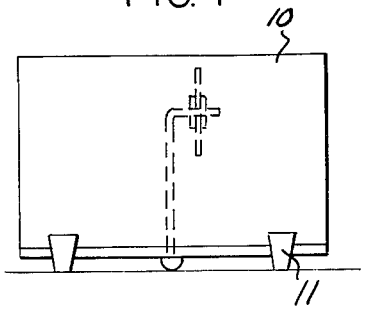
FIG. 2
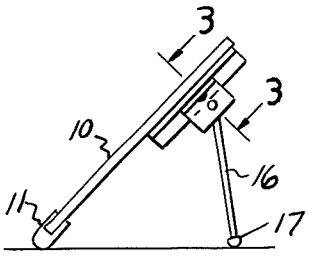
FIG. 3
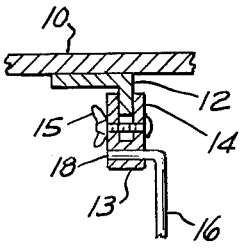
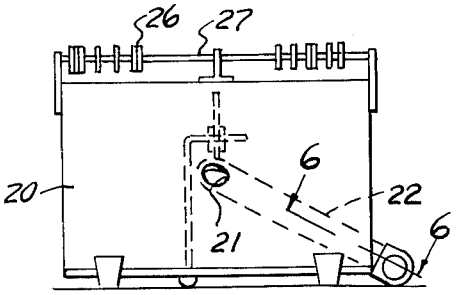
FIG. 4
FIG. 5
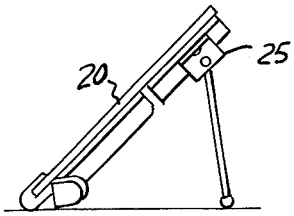
FIG. 6
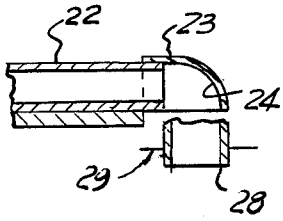
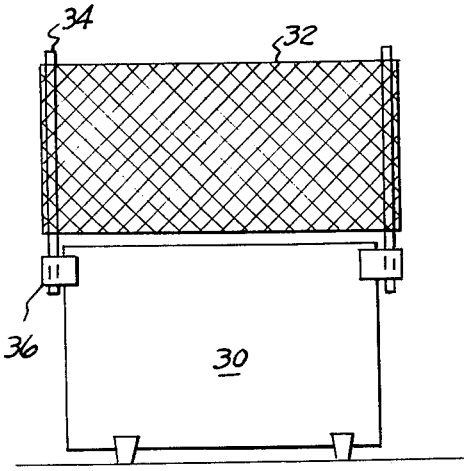
FIG. 7
FIG. 9
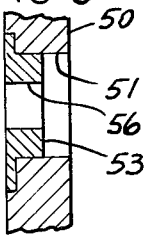
FIG. 12
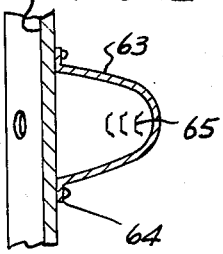
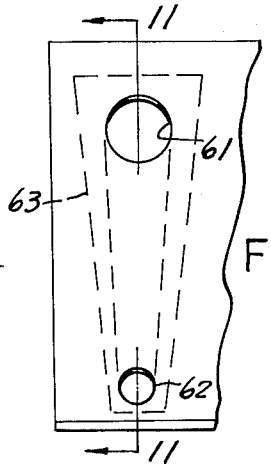
FIG. 10
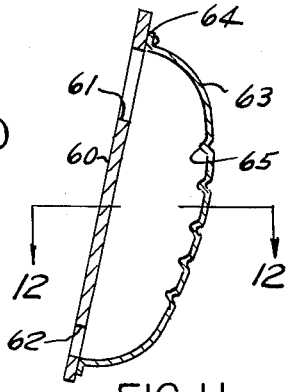
FIG. 11
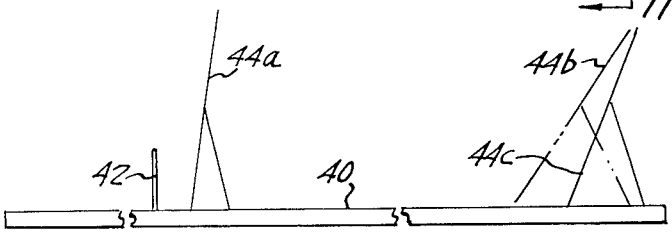
FIG. 8
INVENTOR
JOSEPH A. PSENKA
BY Whittemore, Hulbert & Belknap ATTORNEY

TABLE TENNIS GAME

CROSS-REFERENCE TO RELATED APPLICATIONS

The present application is a continuation-in -part of my prior copending application Ser. No. 187,000 now abandoned filed Oct. 6,1971, which is a continuation-in-part of my prior application Ser. No. 27,125 filed Apr. 9, 1970 (now U.S. Pat. No. 3,659,850), which is a continuation of my prior application Ser. No. 615,816, filed Feb. 13, 1967 (now abandoned).

BRIEF SUMMARY OF THE INVENTION

The present invention relates to equipment with which one or more players may practice table tennis shots or may carry out competitive games. The equipment comprises essentially the combination of a standard ping pong table, which is elongated and is provided midway between its ends with the standard table tennis net. The player or players stand at one end of the table and at the opposite side of the net there is provided a rigid ball return board. This board is of a width substantially less than that of the table tennis table top, ordinarily substantially less than half of its width, and has a height which may be approximately 12 inches. In a particular embodiment of the invention the ball return board is formed of hard rigid plywood having a width of 24 inches, and a slant height of 16 inches.

The board is provided at its rear side with supporting means adjustable to vary the inclination of the board from a vertical plane so as to vary the manner in which a batted table tennis ball bounces from the board toward the player. Preferably, the board support comprises an angularly, and in some cases vertically adjustable leg. The lower edge of the board and the bottom end of the leg are provided with soft friction foot elements which retain the ball return board at whatever location it is placed on the table top and at whatever angular position it is set.

Preferably, the board is provided with an opening substantially larger than the diameter of a standard table tennis ball, as for example a circular opening having a diameter of 4 inches. In order to provide for return of a batted ball which passes through the opening, a chute is provided, preferably at the rear of the board having one end in registration with the opening through the board to receive the ball and to direct it forwardly toward the player. The chute may include an extension beneath the net so that the ball is returned directly to the player.

BRIEF DESCRIPTION OF THE DRAWINGS

FIG. 1 is a front elevational view of a simple form of ball return board shown in position on a table tennis table top.

FIG. 2 is a side elevational view of the board seen in FIG. 1.

FIG. 3 is an enlarged sectional view on the line 3—3, FIG. 2.

FIG. 4 is a front elevational view of a modified form of ball return board.

FIG. 5 is a side elevational view of the board shown in FIG. 4.

FIG. 6 is a fragmentary enlarged section on the line 6—6, FIG. 4.

FIG. 7 is an elevational view of a board provided with an extension net.

FIG. 8 is a diagrammatic view showing the table tennis table top with the ball return board in various locations and positions of angular adjustment.

FIG. 9 is an enlarged sectional view showing structure for changing the dimension of the opening through the board.

FIG. 10 is a fragmentary front elevation showing a modified board construction.

FIG. 11 is a sectional view on the line 11—11, FIG. 10.

FIG. 12 is a fragmentary sectional view on the line 12—12, FIG. 11.

DETAILED DESCRIPTION

Figure 13:
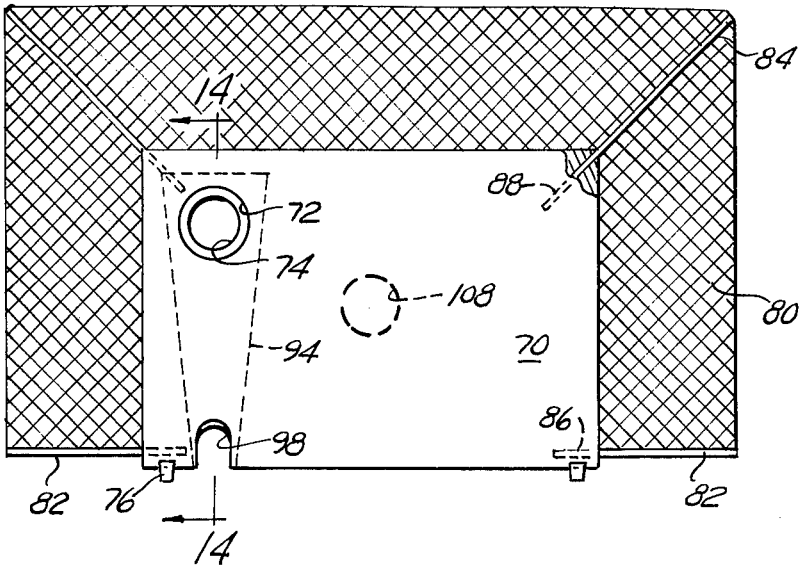
FIG. 13 is an elevational view of the preferred embodiment of the present invention, incorporating the several features previously described.

Referring now to FIGS. 1–3 there is illustrated a ball return board 10 which is in the form of a rectangular board of sufficient thickness and rigidity to provide a satisfactory bounce when a table tennis ball is batted against the board. Conveniently, the board may be formed of plywood. At its lower edge the board is provided with two soft friction foot elements 11 which may be of a suitable material such for example as soft rubber. In addition, means are provided for supporting the board in different positions of angular adjustment. This means comprises a rail 12 at the back of the board formed of angle iron as indicated in FIG. 3. Associated with the rail is a block 13 having jaws 14 adapted to grip the rail under the action of a clamping screw or nut device 15. A support leg 16 having a friction foot 17 formed of the same material as the foot elements 11 has a laterally extending arm 18 received in an opening in the block 13. It will be understood that in practice the ball return board will normally be positioned across the net from the player, and the angle at which the surface of the board is inclined to the vertical will be selected such as to produce the required bounce, taking into account the speed with which the ball is hit. Obviously, if the ball is hit with considerable speed, the practice board will be brought into a much more nearly vertical position than that illustrated.

Moreover, it will be understood that since the ball return board is merely retained in position on the table top at the desired location by the engagement between the friction foot elements 11 and 17, the board may be positioned closely adjacent the rear of the table from the player or it may be brought up much closer to the net. In some cases the net may be removed. In addition, the ball return board, since it is of much less width than the width of the table may have an angularity with respect to the longitudinal axis of the table. Thus for example, the ball return board may be positioned at a location adjacent one rear corner of the table while the player occupies a portion adjacent the diagonally opposite corner.

Referring now to FIGS. 4–6 there is illustrated a modified board 20 which differs principally from the board shown in FIGS. 1–3, in that the board 20 is provided with a central opening 21 of a size substantially larger than the table tennis ball and through which the player attempts to bat the ball. The board is provided with an inclined return chute 22 which may be tubular or which may be closed at one side by the back surface of the board 20. In any case, extension means are provided at the discharge end of the chute to cause the ball to roll forwardly toward the net. This means, as best seen in FIG. 6, comprises a cap element 23 the end surface of which is concave or inclined as indicated at 24 to cause the ball to roll downwardly and then forwardly toward the net. Since the angle of the board to the vertical may be changed by the adjustable support mechanism indicated generally at 25, it is desirable for the cap 23 to be rotatable on the chute member 22. In FIG. 6 the forward end of the tubular extension 28 is shown as extending forwardly of the table tennis net, the position of which is indicated at 29.

If desired, means may be provided on the board for keeping score, as for example a plurality of counters such as apertured discs 26 slidable on a rod 27 mounted at the top of the board. These counters are useful where the game board is used competitively and serve the purpose of keeping score.

Referring now to FIG. 7, a board 30, which may be identical with the board 10 or the board 20, is provided with a net 32. The net may be provided at the sides as well as the top edge of the board so as to intercept balls batted toward the board which miss the target. As illustrated, the net 32 is provided only at the top and this is ordinarily found to be sufficient. The net 32 is mounted on posts 34 which at their lower ends are provided with clamps 36 engageable with edge portions of the board 30. The ends of the net 32 may be doubled to provide loops which may be slipped over the upper ends of the posts 34 to bring the net into the position shown.

Referring now to FIG. 8 there is shown a diagrammatic view of the assembled apparatus including the table tennis top 40 having the usual net 42 provided to extend transversely of the table midway between its ends. Various positions of the ball return board are designated 44*a*, 44*b*, and 44*c*. It will of course be understood that these locations and angular positions of the board are merely illustrative and that according to the speed with which the ball is hit and the particular game which is being played, other positions may be employed.

Since the board is retained at a desired location on the table tennis table top by the soft friction foot elements, it is of course possible to change the location as well as the angular position with reference to the length of the table simply by moving the board to the required position. Inclination of the board with respect to the vertical is accomplished by appropriate adjustment of the support leg 16, either an angular adjustment of the leg relative to the board, or this in combination with a repositioning of the leg supporting block 13. The ball return board is thus characterized by the maximum possible ease of effecting changes in its location and angular adjustment.

Referring now to FIG. 9 there is illustrated an arrangement in which the ball return board, here indicated at 50, is provided with a relatively large through opening 51 surrounded by a recessed groove 52. If the player wishes to use the board with an opening smaller than the opening 51, an annular insert 53 is provided the outer diameter of which is such that it fits closely within the opening 51. The insert 53 is provided at its forward end with a radially extending flange 54 which fits into the annular recess 52. The insert 53 is provided with an opening 56 which is of a size smaller than the opening 51. With this arrangement it will be observed that the opening 56 is surrounded by a flush surface coplanar with the front surface of the board and terminating in a sharply defined corner 57. If the player wishes to use the board with an opening of the size illustrated at 51, the insert 53 is removed and replaced by a washer which seats within the recess 52. The inner diameter of the washer will be the same as the diameter of the opening 51 so that when the washer is employed the opening 51 will be provided at its forward end with a sharply defined corner.

Referring now to FIGS. 10–12 there is illustrated a modified construction in which the board, here designated 60, is provided with an upper enlarged opening 61 and a lower opening 62 dimensioned to pass the conventional table tennis ball. At the rear of the board there is provided guide structure indicated generally at 63, preferably formed of plastic to permit forward passage of the ball through the lower opening 62. The guide structure 63 may be formed from relatively thin plastic material by vacuum forming while in a softened condition. As best seen in FIG. 10, the guide structure 62 converges downwardly so as to guide the ball into proper registration with the exit opening 62. The guie structure includes an attaching flange 64 through which fastening elements such as tacks may be driven.

A feature of the guide structure illustrated in FIG. 11 is the provision of a multiplicity of inwardly extending projections 65 over which a ball is caused to pass and the passage of the ball will cause a sequence of sharply defined sounds. These sounds serve as an audible signal that the ball has passed into the upper opening. It will be understood that in use the table tennis ball will be batted with considerable velocity so that when it enters the upper opening its direction is changed by engagement with the curved contour of the plastic guide structure and it will tend to maintain contact with the inner interrupted surface of the guide structure. Since the table tennis ball is of relatively hard material and the plastic material of the guide structure is relatively hard, the passage of the ball over the curved guide structure will produce the aforementioned audible signal.

As best indicated in FIG. 10, the opening 61 is preferably provided adjacent the top and one side edge of the ball return board. This positions the guide structure 63 laterally from the supporting leg such as shown at 16 in FIG. 2 so that the leg may be swung into vertical abutment with the rear surface of the board so as to permit the assembly to be contained within a more compact container. In addition, of course, the lateral displacement of the opening from the center line of the board may be such as to increase the difficulty of driving a ball through the opening.

Since in normal usage of the ball return board, the net is in position between the player and the board, the net will prevent return of a ball emerging from the lower opening 62 unless special provision is made. Return of the ball to the player may be accomplished simply by elevating the lower portion of the net if desired, so that the ball will roll underneath the net to the player.

Figure 14:
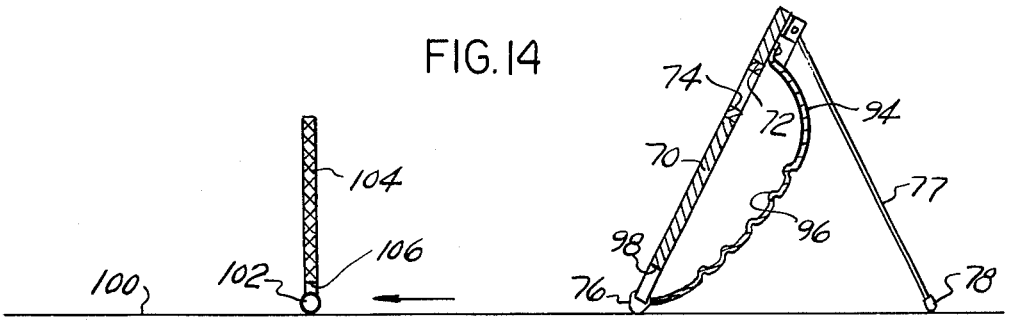
FIG. 14 is a fragmentary sectional view on the line 14—14, FIG. 13.
Figure 15:
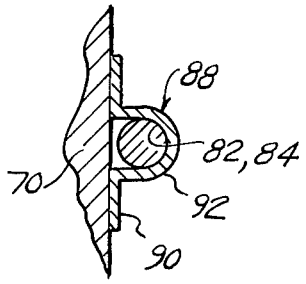
FIG. 15 is a fragmentary sectional view showing post receiving brackets on the board.

FIGS. 13 and 14 illustrate the preferred embodiment of the present invention, combining the several features as described in the foregoing.

In this embodiment of the invention the board is illustrated at 70 and has a ball receiving opening 72 which as illustrated in FIG. 13, has its effective size reduced by insertion of a ring 74 of the type illustrated in FIG. 9. The board is provided at its lower edge with soft supporting feet 76 which cushion the board and absorb the energy delivered to the board by impacting balls. The feet may be made of soft rubber and effectively prevent displacement of the board on the table top by repeated impacts of the balls. The board is illustrated in FIG. 14 as retained in an inclined position by an adjustable brace or leg 77 which may be of the type illustrated in detail in FIGS. 2 and 3. The leg 77 is also provided with a soft high-friction foot 78 which cooperates with the feet 76 in retaining the board in adjustment at the selected position.

The board 70 is surrounded both at the sides and top by a net 80 adapted to receive balls which are misdirected and to return them to the player. The net is supported by two lower posts 82 and two diagonally extending upper posts 84. Conveniently, the posts 82 and 84 may be inserted in openings 86 and 88 provided in the board. Since the posts 84 extend diagonally the netting may be dimensioned so as to be substantially tensioned when placed in the illustrated position. This has the advantage of providing a net surface from which the balls rebound toward the player and may pass under the net as illustrated in FIG. 14. In addition, the tension of the netting 80 retains the diagonally extending posts 84 in position and in fact, urges them inwardly of the inclined openings 88. The tensnon of the netting also biases the posts 82 upwardly and serves to retain them frictionally within the openings 86. Instead of providing openings in the board 70 to receive the inner ends of the posts 82 and 84, it is also contemplated that sheet metal sockets may be affixed to the rear of the board. Such a socket structure is illustrated in FIG. 14 where the socket is indicated generally at 88, and has flat flanges 90 by which it is attached to the rear surface of the board 70. Intermediate the flanges 90 the socket 88 has an elongated U-shaped channel portion 92 in which one of the posts 82 or 84 may be received.

Finally, the embodiment of the invention illustrated in FIG. 13 incorporates a ball return and sound producing housing 94 which is essentially similar to the corresponding element 63 seen in FIGS. 11 and 12. In this case however, the curvature of the housing 94 adjacent the opening 72 or the opening provided by the ring 74, is modified to insure that a ball passing through the opening is directed downwardly and is not permitted to bounce back through the opening. In this case the housing 94 is also provided with the inward projections 96 which produce an audible sound as the ball encounters them on its downward movement. In this embodiment of the invention the bottom edge of the board is notched to provide the opening 98 which is thus more closely adjacent to the surface 100 of the table top. This has the result of insuring that the ball, such as indicated at 102, will roll along the table top toward the player.

In some forms of specific games which have been devised embodying use of the present board, it is desirable for the usual table tennis net 104 to remain in position. It is necessary for ball return to displace the lower edge 106 of the net upwardly to provide clearance for return of the ball 102 beneath the net.

In FIG. 13 the location of the opening 72 is adjacent the upper left hand corner of the board. The precise location of the ball receiving opening is not critical and at 108 there is illustrated an alternative position of the opening centrally of the board.

What I claim as my invention is:

1. Table tennis game and practice equipment for use with a table tennis table comprising a rigid substantially upstanding, and substantially rectangular ball-return board having a width substantially less than the width of a standard size table tennis table, said board having at its rear adjustable downwardly and rearwardly inclined support means to provide for variation in the inclination of the board from the vertical, said board and its support means being freely movable to different positions on the table top, soft energy absorbing and friction feet on the lower edge of said board and on the lower part of said support means, said board having a first upper opening therethrough of a size substantially larger than a table tennis ball and spaced substantially from its lower edge, a second lower opening adjacent the lower edge of said board, guide means at the rear of said board shaped to guide a ball projected through said first opening to said second opening to expel the ball forwardly therefrom to roll along the table top to return it to a player, and net means mounted on said board to extend laterally from both side edges, upwardly from the top edge, and upwardly and outwardly from the corners thereof, said net means comprising net supporting posts projecting laterally from the bottom of the side edges of the board, and upwardly and outwardly extending net supporting posts at the upper corners of said board, mounting sockets associated with the board for receiving the inner ends of the net supporting posts, said net being tensioned to provide for resilient return of balls projected against the net and to urge the upwardly and outwardly extending posts inwardly of their sockets and to frictionally lock the laterally extending posts in their sockets.

2. Table tennis game and practice equipment for use with a table tennis table comprising a rigid substantially upstanding, and substantially rectangular ball-return board having a width substantially less than the width of a standard size table tennis table, said board having at its rear adjustable downwardly and rearwardly inclined support means to provide for variation in the inclination of the board from the vertical, said board and its support means being freely movable to different positions on the table top, soft energy absorbing and friction feet on the lower edge of said board and on the lower part of said support means, said board having a first opening therethrough of a size substantially larger than a table tennis ball and spaced substantially from its lower edge, a second opening adjacent the lower edge of said board, guide means at the rear of said board shaped to guide a ball projected through said first opening to said second opening to expel the ball forwardly therefrom to roll along the table top to return it to a player, and net means mounted on said board to extend laterally from both side edges, upwardly from the top edge, and upwardly and outwardly from the corners thereof, said net means comprising net supporting posts projecting laterally from the bottom of the side edges of the board, and upwardly and outwardly extending net supporting posts at the upper corners of the board, mounting sockets associated with the board for receiving the inner ends of the net support posts, said net being tensioned to provide for resilient return of balls projected against the net and to urge the upwardly and outwardly extending posts inwardly of their sockets and to frictionally lock the laterally extending posts in their sockets, said guide means comprising a thin walled shell having a continuously curved outer wall extending from just above said upper opening to just below said lower opening provided with inwardly extending spaced projections formed from the thin wall material of said shell and engageable with a ball passing through said guide means at the velocity required to bat the ball through said upper opening to produce an audible sound upon engagement with a ball.

3. Table tennis game and practice equipment for use with a table tennis table comprising a rigid ball-return board having a width substantially less than the width of the table, said board having at its rear adjustable downwardly and rearwardly inclined support means to provide for variation in the inclination of the board from the vertical, said board and its support means being freely movable to different positions on the table top, soft energy absorbing and friction feet on the lower edge of said board and on the lower part of said support means, said board having a first opening therethrough of a size substantially larger than a table tennis ball and spaced substantially from its lower edge, a second opening adjacent the lower edge of said board, guide means at the rear of said board shaped to guide a ball projected through said first opening to said second opening to expel the ball forwardly therefrom to roll along the table top to return it to a player, and net means mounted on said board to extend laterally from both side edges, upwardly from the top edge, and upwardly and outwardly from the corners thereof, said first opening having a shallow recess surrounding the opening at the front of the board, an insert ring having a through opening smaller than the board opening and dimensioned to fit within the board opening, said insert having a radial flange shaped to fit within said recess, the forward face of said insert including said flange being flat and coplanar with the front surface of said board when the insert is mounted in said first opening.

* * * * *